US005534062A

United States Patent [19]

Dawson et al.

[11] Patent Number: 5,534,062

[45] Date of Patent: Jul. 9, 1996

[54] OIL RESERVOIR

[75] Inventors: Keith Dawson, Bacup; Robert Hayhurst, Bury, both of Great Britain

[73] Assignee: W. L. Gore & Associates (UK) Ltd., London, United Kingdom

[21] Appl. No.: 318,644

[22] PCT Filed: Mar. 19, 1993

[86] PCT No.: PCT/GB93/00563

§ 371 Date: Jan. 11, 1995

§ 102(e) Date: Jan. 11, 1995

[87] PCT Pub. No.: WO93/20483

PCT Pub. Date: Oct. 14, 1993

[30] Foreign Application Priority Data

Apr. 7, 1992 [GB] United Kingdom ..... 9207571

[51] Int. Cl.[6] ..... B05C 11/00

[52] U.S. Cl. ..... 118/60; 355/284

[58] Field of Search ..... 355/283, 284; 118/60, 260, 264, 268; 492/17, 18

[56] References Cited

U.S. PATENT DOCUMENTS

| | | | |
|---|---|---|---|
| 3,831,553 | 8/1974 | Thettu | 118/226 |
| 3,980,424 | 9/1976 | Latone | 355/283 X |
| 4,309,957 | 1/1982 | Swift | 118/60 |
| 4,668,537 | 5/1987 | Matsuyama et al. | 118/60 X |
| 5,232,499 | 8/1993 | Kato et al. | 118/244 |
| 5,267,004 | 11/1993 | Mills | 355/284 |

FOREIGN PATENT DOCUMENTS

| | | |
|---|---|---|
| 0479564 | 10/1991 | European Pat. Off. . |
| 0450894 | 11/1991 | European Pat. Off. . |
| 4121962 | 6/1991 | Germany . |
| 2242431 | 10/1991 | United Kingdom . |

OTHER PUBLICATIONS

JP 62–178992 A—Patent Abstract of Japan (Japan Gore–Tex, Inc.) vol. 12, No. 25 (P∝659) 26 Jan. 1988.
vol. 10, No. 348 (P–519) 22 Nov. 1986 (Abstract of Japan) JP,A,61 148 479 (Nitto Kogyo K. K.) 7 Jul. 1986.
vol. 16, No. 409 (P–1412) 28 Aug. 1992 JP,A,04 139 477 (Japan Gore Tex) 13, May 1992 (Abstract of Japan).

*Primary Examiner*—Robert Beatty
*Attorney, Agent, or Firm*—Gary A. Samuels

[57] ABSTRACT

An oil supply device for supplying oil to a roll of an image reproduction machine, which includes an oil reservoir formed of an open-cell melamine foam; and a layer of oil permeation control material extending over the reservoir for controlling supply of oil from the reservoir to the roll. The oil permeation control material being formed of porous PTFE produced by fusing particles of grannular PTFE such as to form a porous integral network of interconnected particles.

6 Claims, 2 Drawing Sheets

OIL RESERVOIR

FIELD OF THE INVENTION

The present invention relates to material for use as an oil reservoir for applying release oil to a fuser roll in an image reproduction.

As used herein, the term "image reproduction" relates to machines which employ heated fuser rolls, for example plain paper copying machines and laser printers.

BACKGROUND OF THE INVENTION

In a plain paper copying machine, toner images applied to the surface of paper or other recording medium are fixed by application of heat and pressure. In certain plain paper copying machines, fixation is accomplished by passing the image-bearing recording medium between a hot thermal fuser roll and a pressure roll. When this type of thermal fixation device is used the toner material is directly contacted by a roll surface, and a portion of the toner usually becomes adhered to the roll surface. On subsequent rotation of the roll, the adhered toner material may be re-deposited on the recording medium resulting in undesirable offset images, stains, or smears; or in severe cases the recording medium may stick to the adhered toner material on the roll and become wrapped around the roll.

To counter these problems, materials having good release properties such as silicone rubber or polytetrafluoroethylene are often used for the roll surfaces. Although improving the performance of the thermal fixation devices, use of silicone rubber or polytetrafluoroethylene roll surfaces alone does not eliminate the problem. Another approach is to include release agents with the toner materials, which prevent the toner materials from adhering to the roll surface. These oil-less toners improve the performance of the thermal fixation devices but again, particularly in the case of high-speed type copying machines, do not completely eliminate the problems associated with toner pick-up and transfer.

Toner pick-up by the rolls can be controlled by coating the surface of at least one of the rolls with a liquid release agent, such as a silicone oil. It is important that the release liquid be applied uniformly and in precise quantities to the surface of the roll. Too little liquid, or non-uniform surface coverage, will not prevent the toner from being picked up and re-deposited on the roll. On the other hand, excessive quantities of the release liquid may cause silicone rubber roll surfaces to swell and wrinkle, thus producing copies of unacceptable quality.

Devices to meter and coat a release liquid uniformly onto copy machine roll surfaces are described in Japanese laid-open patent number 62-178992. These devices consist of an oil permeation control layer adhered to a thick porous material which serves as a wick or reservoir for supplying oil to the permeation control layer. The permeation control layer controls the amount of oil delivered to the roll surface. The thick porous material to which the permeation control layer is adhered is typically a porous felt of Nomex (trademark) fibres, glass fibres, carbon fibres, polytetrafluoroethylene (PTFE) fibres, or other high temperature fibre. Fibres sold under the Nomex trademark are aramid fibres, a type of polyamide.

U.S. Pat. No. 4,668,537 describes a sliding-type applicator for release oil formed of a felt for holding the release oil, and a porous polytetrafluoroethylene (PTFE) membrane laminated over the felt by means of an FEP (tetrafluoroethylene-hexafluoropropylene copolymer) film. The FEP film is only applied along marginal portions of the felt.

U.S. Pat. Nos. 3,831,553 and 3,980,424 also describe arrangements for oiling or cleaning a fuser roll.

European patent application 91309005.6 (0479564) laid open on Apr. 8, 1992 discloses an oil-filled reservoir in the form of a roller. The device comprises a liquid permeation control layer of porous expanded PTFE membrane adhered to a porous tubular reservoir. The reservoir comprises an open-cell thermosetting polymer foam which requires to be internally reinforced to obtain the strength, resilience, and heat resistance needed for high durability in use as part of a hot toner image fixation mechanism in a plain paper copying machine. The thermosetting polymer foam is a melamine resin, a polyimide resin, a phenolic resin, or bismaleimide-triazine resin. An internal reinforcing layer is formed of silicone oil and silicone rubber within the outer surface of the reservoir roller.

SUMMARY OF THE INVENTION

The present invention provides an oil supply device for supplying oil to a roll of an image reproduction machine, which comprises;

an oil reservoir formed of an open-cell melamine foam; and a layer of oil permeation control material extending over the reservoir for controlling supply of oil from the reservoir to the roll.

THE INVENTION

Melamine foam is suitable for use as an oil reservoir material for applying oil to a hot fuser roll. An advantageous property of open-cell melamine foam relates to its improved oil holding capacity, for example in relation to conventional aramid felt (available under the Nomex trademark) reservoirs. In practice, oil supply devices according to present invention have been found to have a life prior to failure which is improved in comparison to conventional devices.

In order to perform satisfactorily at temperatures commonly encountered in use, the open-cell melamine foam oil reservoir is capable of operating at a continuous working temperature of about 200° C. The foam material may in fact be capable of operating in continuous service at higher temperatures, such as 220° C. In contrast conventional Nomex (trademark) felt reservoirs tend to have a maximum operating temperature of about 170° C. in continuous service.

The foam material has a suitable speed of wicking in order to deliver sufficient quantities of oil to the oil permeation control layer, particularly for high speed applications where an oil-fed reservoir will usually be employed. In an oil-fed reservoir, the reservoir is primed with oil and oil is also delivered during use, usually by a metering pump. In oil-filled reservoirs, the reservoir is prefilled with its supply of oil, which is continuously delivered until used up, when replacement of the reservoir is necessary.

The particular physical form of the oil supply device of the present invention will be chosen to match the configuration of the particular reproduction machine in which it is to be used. In one embodiment, the oil supply device of the present invention will be in the form of a roller, which may be oil-filled or oil-fed. In another embodiment, the oil supply device may be in the form of an oil-filled or oil-fed pad.

Figure 3:
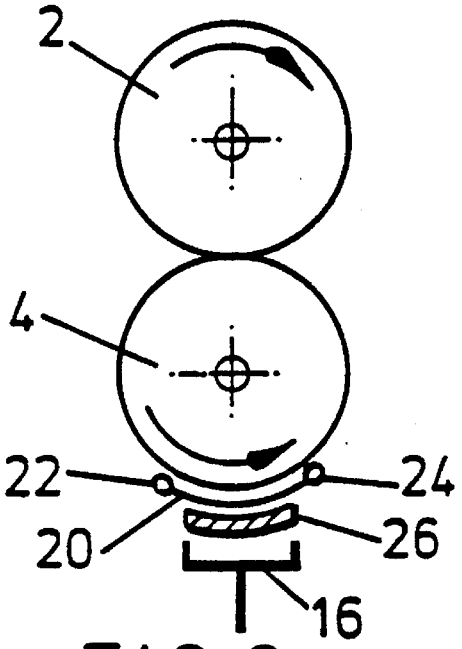
FIG. 3 shows schematically a fuser roll arrangement in a reproduction machine, which employs an oil supply device according to the present invention in the form of an oil-fed reservoir pad as shown in FIG. 1 and a separate oil permeation control layer.

Depending on the particular configuration of reproduction machine into which the oil supply device of the present invention is fitted, the oil may be applied directly onto the fuser roll or may be applied indirectly to the fuser roll by application onto another roll running in contact with the fuser roll (see for example FIG. 3 herein).

In order to have good oil holding capacity, the foam material of the present invention should preferably have a pore volume in the region 50 to 95%, preferably 75 to 95%. The foam materials of the present invention generally contain up to 1 g/ml (for example between 0.6 and 0.9 g/ml) of oil. In comparison, conventional Nomex felt reservoirs hold a maximum of about 0.6 g/ml of oil. Thus the reservoir of the present invention has an enhanced oil holding capacity.

Typically, the foam material has a density in the region 7 to 15 kg/m$^2$.

Generally, the oil reservoir will have a thickness (in the case of a pad) or a diameter (in the case of a roller) of 4 to 20 mm, preferably 4 to 12 mm. Usually, the foam material will have a resilient nature, so as to conform to the shape of the fuser roll.

An open-cell melamine foam found to be suitable for use as the oil reservoir of the present invention is available under the trademark BASOTECT from BASF (available in the U.K. from Noise Control Centre).

Notwithstanding European patent specification EP0479564, it has been found that an open-cell melamine foam material which is free of any reinforcing layer internally within the foam material may be used. In other words, it is not necessary to provide an internal reinforcing layer as taught in EP0479564 in order to obtain the advantageous long-life properties exhibited by the present invention.

The oil reservoir is employed in conjunction with an oil permeation control material, which lies between the oil reservoir and the roll of the reproduction machine, and controls the rate of permeation of oil from the reservoir. The thickness of the oil permeation control layer is typically 75 to 500 microns, useful thicknesses being 125 and 375 microns. The permeation control layer may be provided as a separate item or may be laminated to the surface of the oil reservoir. Thus, for use in one particular type of reproduction machine (see for example FIG. 3), the oil permeation control layer is provided as a separate cover wick, which is supported on a frame or pair of parallel rods extending along either side of the cover wick strip in order to mount it in the reproduction machine.

It is a particularly preferred feature of the present invention that the oil permeation control layer be formed of a porous polytetrafluoroethylene structure as disclosed in our published British patent specification GB2242431 (9106768.6) and referred to in our pending application GB9122750.4. The porous polytetrafluoroethylene material is produced by fusing particles of granular-type polytetrafluoroethylene such as to form a porous integral network of interconnected particles. The disclosure of this patent specification (which is particularly concerned with the filtration of aqueous slurries) is incorporated herein. A particularly useful product for use in the present invention comprises 40 to 60% of Teflon (trademark) resin grade 7A; and 40 to 60% of Teflon resin grade 9B. Teflon resin grade 7A and 9B are available from DuPont Speciality Polymers Division, Wilmington, U.S.A. The porous polytetrafluoroethylene structure is usually prepared by spraying onto a substrate, such as a ceramic tile or sheet of metal.

Figure 1:
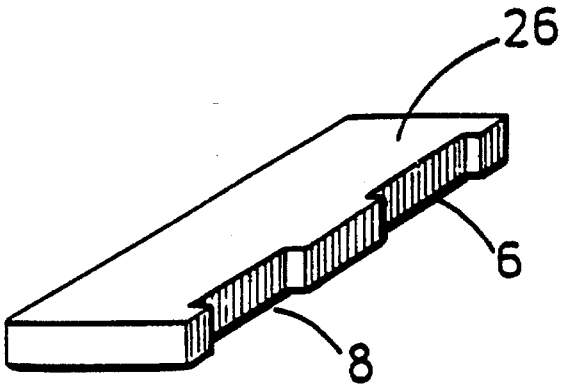
FIG. 1 shows an oil-fed reservoir pad, which is intended for use in an oil supply device of the type shown in FIG. 3, together with an oil permeation control layer in the form of a so-called cover wick.

FIG. 1 shows a reservoir pad 26 of the oil-fed type. The pad is formed of BASOTECT (trademark) open-cell melamine foam, and has a thickness 4 mm to 20 mm; and is capable of operating at temperatures of at least 200° C. So as to allow the pad to be fitted into a conventional plain paper copying machine, the pad is provided with suitable cutouts 6, 8. In order to control the flow of oil from the open-cell melamine foam pad 26, the pad is intended to be used in conjunction with a separate cover wick formed of an oil permeation control material, as will be described hereafter in conjunction with FIG. 3.

Figure 1A:
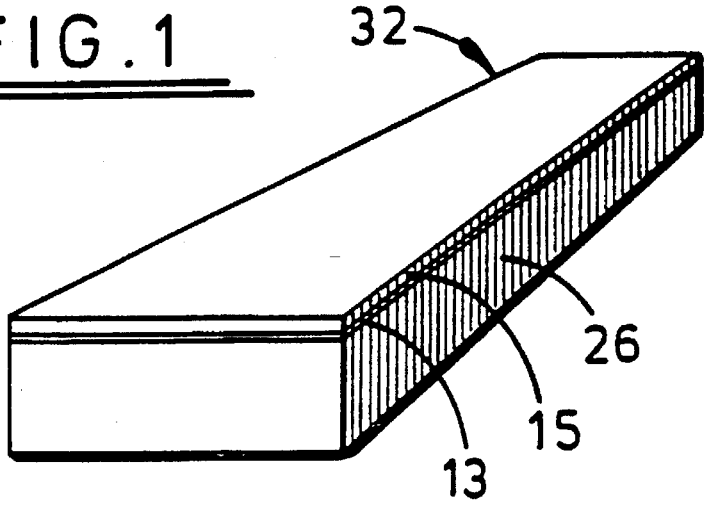
FIG. 1A shows an embodiment of the present invention in the form of an oil-filled reservoir pad having a porous polytetrafluoroethylene (PTFE) oil control layer laminated thereon.

FIG. 1A shows a laminated pad 32, which is suitable for oil-fed or oil-filled use. It comprises an oil permeation control layer 15 of porous polytetrafluoroethylene (PTFE) prepared according to patent specification GB2242431. The permeation control layer is adhered to a pad 26 by means of a layer of adhesive dots 13. The pad 26 is formed of an open-cell melamine foam capable of operating at a working temperature of at least 200° C. This laminated pad is suitable for use in a laser printer fuser roll arrangement of the type shown in FIG. 5 as will be described hereafter.

Figure 2:
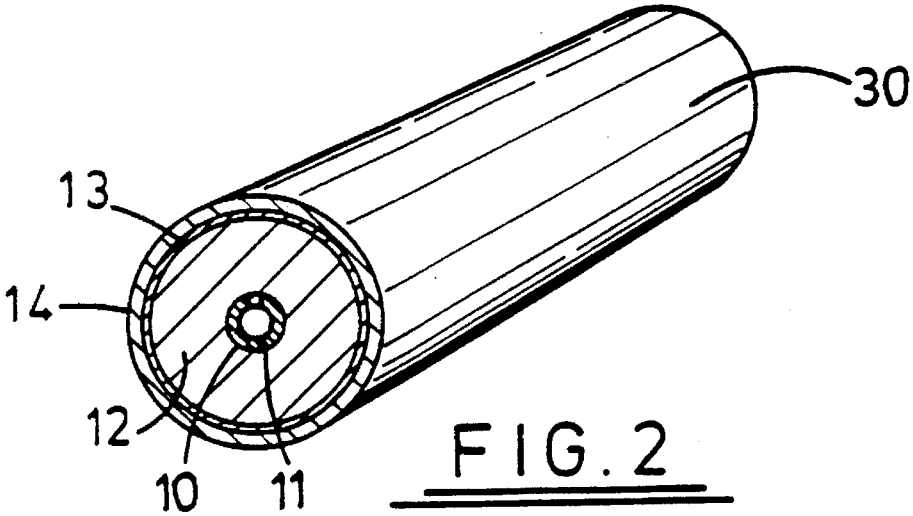
FIG. 2 shows a further embodiment in the form of an oil-fed roller comprising an oil reservoir and an oil control permeation outer layer adhered thereto.

FIG. 2 shows an oil-fed roller assembly 30. The assembly comprises a hollow central shaft 10. The hollow central shaft includes oil delivery slots 11 through which oil is fed into a cylindrical oil reservoir 12 provided with an oil permeation control layer 14. The cylindrical oil reservoir is formed of open-cell BASOTECT (trademark) melamine foam capable of operating at a working temperature of at least 200° C., which has been moulded or ground to shape. The oil permeation control layer 14 constituting the outer surface of the roller is formed of a porous polytetrafluoroethylene material comprising 50% Teflon grade 7A and 50% Teflon grade 9B, produced according to Example 1 of patent specification GB2242431. In the production of the oil supply roller, the oil control permeation layer is wound around the oil reservoir 12 and adhered thereto by means of adhesive dots 13. The edges of the oil permeation control layer 14 are slightly overlapped to form a longitudinal seam (not shown).

The same general construction can also be used for producing an oil-filled roller. However, in the case of an oil-filled roller, the central shaft 10 is in the form of a solid shaft.

Figure 4:
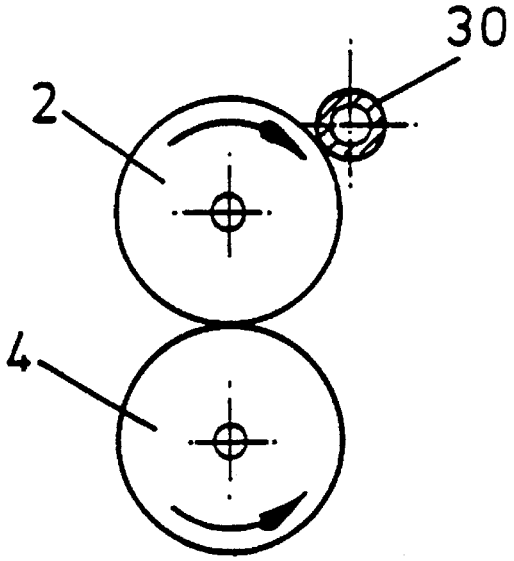
FIG. 4 shows schematically a further fuser roll arrangement together with an oil-fed roller of the type shown in FIG. 2.
Figure 5:
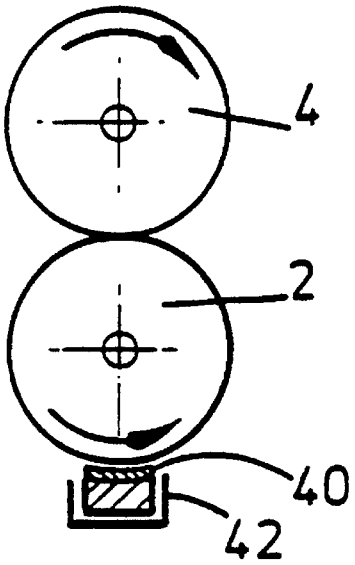
FIG. 5 shows schematically a fuser roll arrangement as employed in a laser printer, together with an oil supply device of the type shown in FIG. 1A.

FIGS. 3, 4 and 5 show different fuser roll arrangements as employed in various types of reproduction machines (including plain paper copiers and laser printers) in order to show the operation of the oil supply devices shown in FIGS. 1, 1A and 2.

FIG. 3 shows a fuser roll arrangement which employs an oil supply device comprising an oil reservoir in the form of an open-cell melamine pad 26 as shown in FIG. 1, together with a permeation control layer 20 in the form of a separate so-called cover wick. The permeation control layer 20 is separate from the reservoir pad 26 and not attached thereto, but is arranged to overlie the reservoir so as to control the supply of oil from the reservoir. The permeation control layer 20 is supported at either side in known manner on a pair of rods 22, 24. The fuser roll arrangement comprises a PTFE-covered fuser roll 2 and a silicone rubber covered roll 4 rotating in contact therewith. The oil supply device is of the oil-fed type and silicone oil is supplied to the oil supply device by means of an oil supply mechanism 16 of known type. In use, oil is fed to the oil supply mechanism 16 which in turn applies oil to the oil reservoir pad 26 and then through the oil permeation control layer 26 to the silicone rubber covered roll 4. The silicone rubber covered roll 4 rotates together with the PTFE covered fuser roll 2. In this way, silicone oil applied to the silicone rubber covered roll 4 is transferred onto the fuser roll 2.

FIG. 4 shows a further fuser roll arrangement, in which the oil supply device is a roller 30 of the type shown in FIG. 2. The fuser roll arrangement comprises a PTFE-covered fuser roll 2 rotating in contact with a silicone rubber covered roll 4. The oil supply roller 30 delivers oil directly onto the fuser roll 2. The roller 30 is of the oil fed type shown in FIG. 2. Oil is supplied into the centre of the roller 30 by an oil supply mechanism as described previously in relation to FIG. 2. The roller 30 might alternatively be of the oil-filled type.

In a further alternative arrangement (not shown), the oil supply roller 30 is arranged to run in contact with the silicone rubber covered roll 4. In this case, oil applied to the silicone rubber covered roll 4 is transferred indirectly on to the fuser roll 2 as the two rolls rotate in contact with each other.

FIG. 5 shows a fuser roll arrangement of the type employed in laser printers. Once again, the fuser roll arrangement comprises a PTFE-covered fuser roll 2 and a silicone rubber covered roll 4. An oil supply device 40 is in the form of an oil-filled laminated reservoir pad overlain by an oil permeation control layer as shown in FIG. 1A. The oil supply device 40 is located in a channel 42. The oil supply device 40 applies a controlled amount of oil directly onto the PTFE-covered fuser roll 2; and also cleans excess toner from the fuser roll 2.

EXAMPLE 1

(laminated pad)

A release oil-supply pad of the type shown in FIG. 1A was produced by laminating a layer of porous PTFE (50% grade 7A and 50% grade 9B produced according to GB2242431) of thickness 380 microns (15 thousands of an inch) to an open-cell melamine foam pad (BASOTECT) of thickness 14 mm. Lamination was carried out by gravure printing or screen printing a pattern of dots of a polyimide resin in acetone onto the porous PTFE, drying at about 130° C.; and heating at about 175° C. under pressure in contact with the melamine foam pad.

The laminated pad of the invention was then installed in a Kodak Ektaprint 850 plain paper copying machine in place of the conventional pad (formed of a Nomex felt reservoir with a Nomex felt fabric cover layer). The machine was operated in the normal way at an operating temperature of at least 200° C. The pad of the invention had not failed when it was replaced after a million copies, which is at least four times the normal lifetime of the conventional pad. In addition, the life of the fuser roll was found to be extended by about 25% due to the improved control of oil feed by the pad of the invention. Excess oil applied to the fuser roll causes swelling of the roll and can contribute to failure of the roll.

EXAMPLE 2

A similar laminated pad to that described in Example 1 of width 38 mm (reservoir thickness 7 mm) was installed in a Siemens laser printer in place of the conventional oil supply pad. The pad contained 18 g of oil in comparison to 6 g for the conventional Nomex felt reservoir. The pad of the present invention achieved 350,000 copies (in comparison to an average of around 60,000 copies for the conventional pad) at an operating temperature of at least 200° C.

EXAMPLE 3

An oil-supply pad of the type shown in FIG. 1A was produced as described in Example 1, except that the layer of porous PTFE was laminated to the melamine foam pad using a silicone adhesive (Dow Corning 732 RTV) which was applied at room temperature without the use of heat or pressure.

We claim:

1. An oil supply device for supplying oil to a roll of an image reproduction machine, which consists of an oil reservoir formed of an open-cell melamine foam which is free of any reinforcing layer internally within the foam; and a layer of oil permeation control material extending over the reservoir for controlling supply of oil from the reservoir to the roll, said oil permeation control material being formed of porous polytetrafluoroethylene (PTFE), produced by fusing particles of granular PTFE such as to form a porous integral network of interconnected particles.

2. A device according to claim 1 wherein the layer of oil permeation material is laminated onto a surface of the oil reservoir.

3. A device according to claim 2 wherein the oil supply device is in the form of a roller, the oil reservoir being substantially cylindrical.

4. A device according to claim 3 wherein the roller is oil-fed and the cylindrical reservoir comprises a hollow central shaft having oil delivery slots for feeding oil into the center of the cylindrical oil reservoir.

5. A device according to claim 1 wherein the reservoir is filled with oil.

6. A device according to claim 1 wherein the oil supply device is in the form of a pad.

* * * * *